US006237173B1

(12) United States Patent
Schlichter et al.

(10) Patent No.: US 6,237,173 B1
(45) Date of Patent: May 29, 2001

(54) ARTICULATED FOAM FUTON MATTRESS

(75) Inventors: Mark E. Schlichter, Chippewa Falls; Mark S. Barton, Augusta, both of WI (US)

(73) Assignee: August Lotz Co., Inc., Boyd, WI (US)

( * ) Notice: Subject to any disclaimer, the term of this patent is extended or adjusted under 35 U.S.C. 154(b) by 0 days.

(21) Appl. No.: 09/522,583

(22) Filed: Mar. 9, 2000

Related U.S. Application Data

(60) Provisional application No. 60/124,465, filed on Mar. 15, 1999.

(51) Int. Cl.[7] ..... A47C 27/15; A47C 27/14
(52) U.S. Cl. ..... 5/722; 5/740; 5/953
(58) Field of Search ..... 5/722, 705, 12.1, 5/740, 727, 953

(56) References Cited

U.S. PATENT DOCUMENTS 2,830,306 * 4/1958 Wagner et al. ..... 5/740
4,985,951 * 1/1991 Lacotte et al. ..... 5/740
5,657,500 8/1997 Messina ..... 5/722
5,669,094 * 9/1997 Swanson ..... 5/740
5,953,778 9/1999 Hiatt ..... 5/716
6,052,851 * 4/2000 Kohnle ..... 5/690

* cited by examiner

*Primary Examiner*—Alexander Grosz
(74) *Attorney, Agent, or Firm*—Andrus, Sceales, Starke & Sawall, LLP

(57) ABSTRACT

An articulated foam mattress including a back section and a seat section joined to each other by a hinge section. Both the back section and the seat section are formed from polyurethane foam. The hinge section is formed from visco-elastic foam, commonly referred to as memory foam. The visco-elastic foam hinge section retains its compressed condition as the mattress is folded from the upright position to the seating position. The visco-elastic foam of the hinge section reduces the reflex properties of the mattress to reduce the urge of the mattress to slide off of the furniture frame.

10 Claims, 3 Drawing Sheets

ARTICULATED FOAM FUTON MATTRESS

CROSS-REFERENCE TO RELATED APPLICATION

This application is based on and claims priority from Provisional Patent Application Ser. No. 60/124,465 filed on Mar. 15, 1999.

BACKGROUND OF THE INVENTION

The present invention generally relates to a mattress for use in connection with convertible furniture, such as futons. More specifically, the present invention relates to a foam mattress that includes a hinge section that allows the mattress to remain in the upright, seating position without sliding off of the furniture frame.

In presently available convertible furniture, such as futons, the furniture includes a frame that is movable between an upright, seating position and a horizontal, sleeping position. The convertible furniture includes a mattress enclosed within a decorative covering that is placed on the furniture frame and acts as a cushion for the seat and back when the convertible furniture is in the upright position and functions as a mattress when the convertible furniture is in the horizontal, sleeping position.

Currently, the two most common types of futon mattresses are formed from either cotton or wool batting or foam, or a combination thereof, to provide the required cushioning when the mattress is positioned in either the upright position or the sleeping position. Currently, futon mattresses having a polyurethane foam core are the most popular due to their light weight and superior cushioning capabilities.

Although foam core futon mattresses have proven to be very comfortable, one problem that does exist is the desire for the foam core to return to the flat, horizontal sleeping position when it is bent upon itself in the upright, sitting position. Thus, when the mattress is folded onto itself while in the upright position, the foam positioned within the bend of the mattress has a tendency to urge the mattress back into the horizontal position, thus causing the mattress to slide off of the furniture frame.

Therefore, a need exists for a convertible furniture mattress that includes a hinge section that allows the mattress to retain its position when the convertible furniture frame is in the upright, seating position. Further, it is an object of the present invention to provide a mattress that provides the required cushioning for the furniture while also including the hinge section that allows the mattress to be folded upon itself. Further, it is an object of the present invention to provide a mattress that retains its folded position yet is able to rebound back to its full height in the sleeping position for the comfort of the user.

SUMMARY OF THE INVENTION

The present invention is an articulated mattress for use with convertible furniture, such as a futon. The articulated mattress of the present invention includes a foam core that is comprised of a seat section and a back section joined to each other by a hinge section. Specifically, the hinge section is adhesively attached between the inside edges of both the back section and the seat section.

Both the seat section and the back section are formed from a polyurethane foam, such as is conventionally used in currently available convertible furniture mattresses. In accordance with the invention, the hinge section is formed from a visco-elastic foam, commonly referred to as memory foam. Visco-elastic foam generally retains its shape as it is compressed.

When the articulated mattress of the present invention is moved from the horizontal, sleeping position to the upright, sitting position, the mattress flexes along the hinge portion. The visco-elastic foam that forms the hinge portion compresses and generally retains its compressed shape. The inherent properties of the visco-elastic foam allows the articulated mattress to remain in the upright, sitting position without the hinge section causing the mattress to spring back into its horizontal, sleeping position.

The articulated mattress of the preferred embodiment includes both a top foam layer and a bottom foam layer. The top foam layer is adhesively attached to the top face surface of the back section, the hinge section, and the seat section. The bottom foam layer is adhesively attached to the bottom face surface of the back section, the hinge section and the seat section. The bottom and top foam layers increase the comfort of the articulated mattress and reduce the difference in feel between the polyurethane foam of the back and seat sections and the visco-elastic foam of the hinge section.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
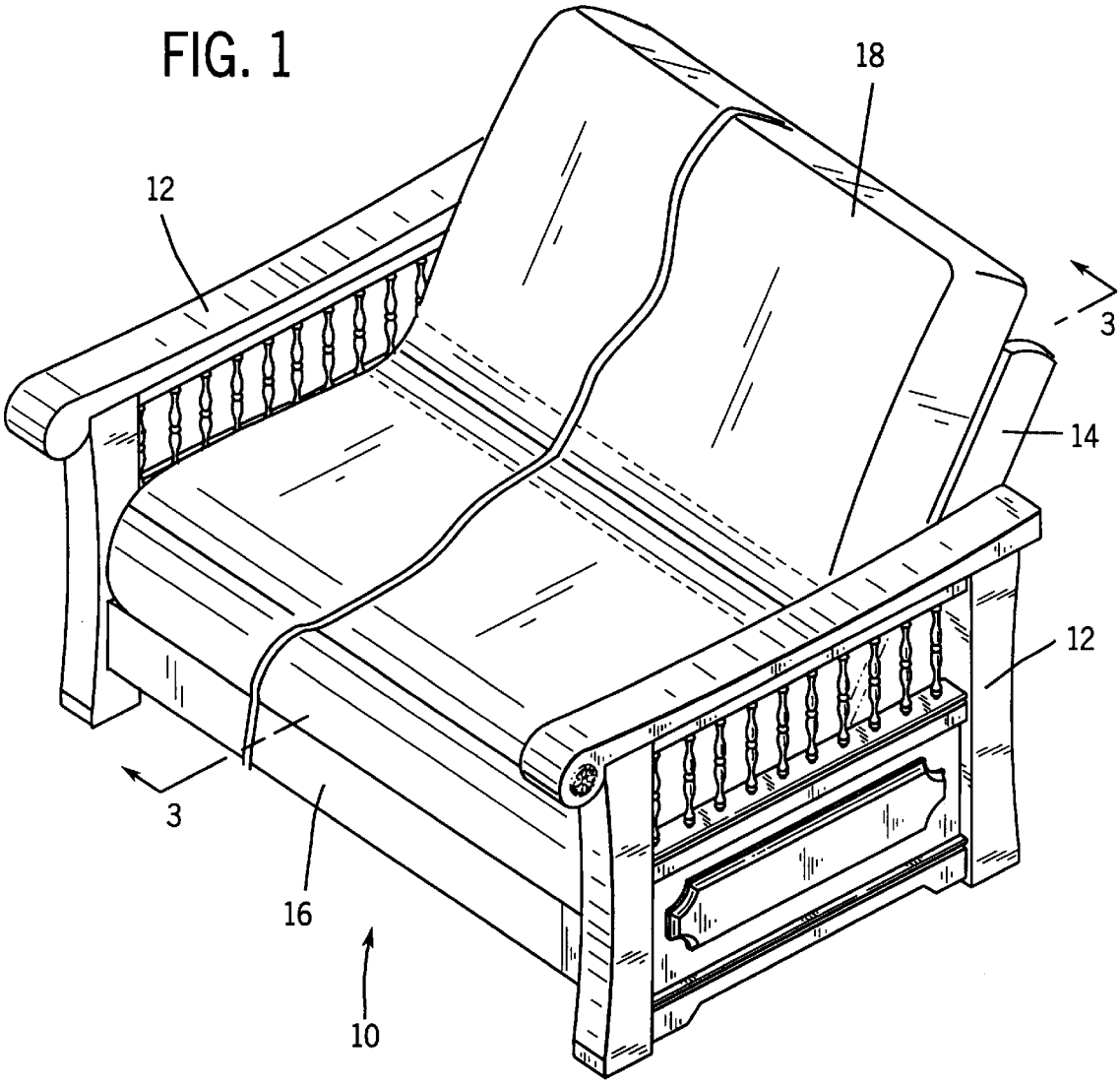
FIG. 1 is a perspective view of a piece of convertible furniture including the mattress of the present invention.

FIG. 1 illustrates a piece of convertible furniture 10 having a frame consisting of a pair of side arms 12, a back 14 and a seat support 16. The back 14 and seat support 16 are movable from the upright, seating position shown in FIG. 1 to a horizontal, sleeping position in which the back member 14 is horizontally aligned with the seat support 16.

The convertible furniture 10 is shown in FIG. 1 including an articulated mattress 18 constructed in accordance with the present invention. As can be seen in FIG. 1, when the frame of the convertible furniture 10 is in the upright, seating position, the mattress 18 acts as both the seat and back cushion. Likewise, when the frame of the convertible furniture 10 is moved to the horizontal, sleeping position, the mattress 18 lies flat and acts as a cushion for a person to sleep upon.

As discussed previously, conventional convertible furniture mattresses are typically formed from a monolithic polyurethane foam core covered by a decorative piece of material. A conventional foam core mattress creates a problem in that when the frame of the convertible furniture is in the upright, seating position, the folded foam core of the mattress urges the mattress to flex back to the planar position and thus slide off of the frame.

Figure 3:
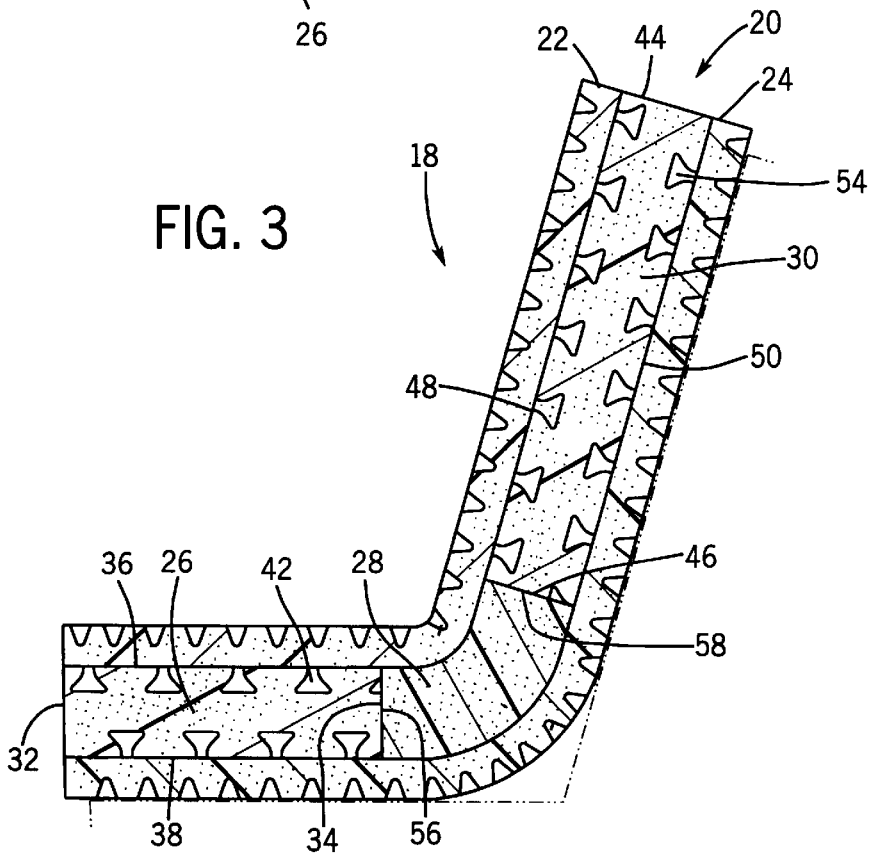
FIG. 3 is a section view taken along line 3—3 of FIG. 1, illustrating the function of the hinge section when the mattress is folded upon itself in the upright, seating position.
Figure 4:
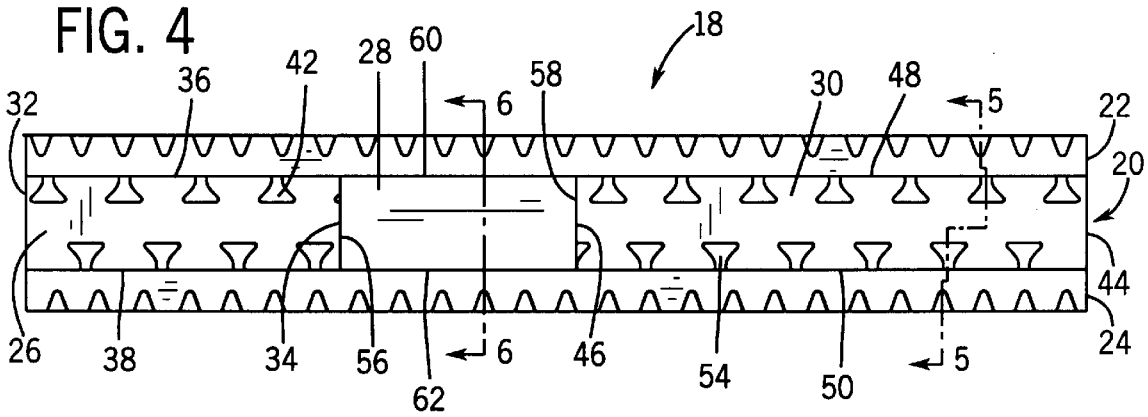
FIG. 4 is a side view of the mattress taken along line 4—4 of FIG. 2.

In accordance with the preferred embodiment of the present invention, the mattress 18 includes a foam core 20 sandwiched between a top foam layer 22 and a bottom foam layer 24, as best seen in FIGS. 3 and 4. As shown in FIGS. 3 and 4, the foam core 20 includes a seat section 26, a hinge section 28 and a back section 30.

Figure 2:
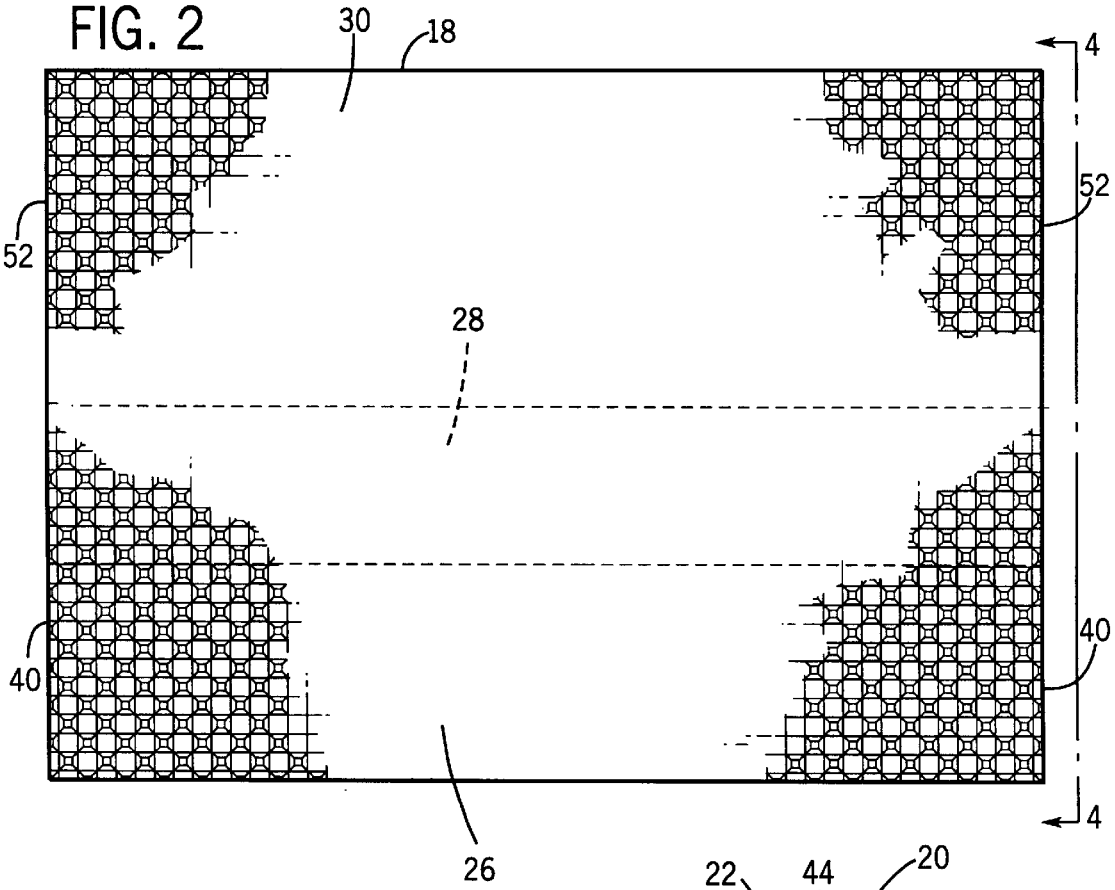
FIG. 2 is a top plan view of the mattress of the present invention in the horizontal, sleeping position.

As can be seen in FIGS. 2 and 3, the seat section 26 of the foam core 20 extends across the entire width of the mattress 18 and is generally defined by an outer edge 32, an inner edge 34, a top face surface 36, a bottom face surface 38 and a pair of spaced side edges 40. The seat section 26 is a continuous piece of high quality polyurethane foam that extends across the entire width of the mattress 18 between the pair of spaced side edges 40. As can be seen in FIG. 3, the seat section 26 includes a plurality of cushioning recesses 42 that extend inward from the respective top and bottom face surfaces 36 and 38. In the preferred embodiment of the invention, the length of the seat section 26 between the outer edge 32 and the inner edge 34 is approximately 16 inches, while the width of the core section 26 between the spaced side edges 40 is approximately 75 inches. Clearly, the dimensions of the seat section 26, as well as the entire mattress 18 are determined by the size of the convertible furniture and are being given for illustrative purposes only and should not be viewed as a limitation on the invention.

The back section 30 of the foam core 20 is also formed from the same type of high quality polyurethane foam that forms the seat section 26. The back section 30 includes an outer edge 44, an inner edge 46, a top face surface 48, a bottom face surface 50 and a pair of spaced side edges 52. The back section 30 also includes the series of longitudinal cushioning recesses 54.

In the preferred embodiment of the invention, the length of the back section 30 between the inner edge 46 and the outer edge 44 is 26 inches, while the width between the spaced side edges 52 is again 75 inches. The thickness of both the back section 30 and the seat section 26 is five inches.

Referring now to FIGS. 3 and 4, the specifics of the hinge section 28 of the present invention will now be discussed. The hinge section 28 is positioned to provide a flexible connection between the seat section 26 and the back section 30. Specifically, the hinge section 28 is adhesively attached between the inside edge 34 of the seat section 26 and the inside edge 46 of the back section 30. As can be seen in FIG. 3, when the mattress 18 is moved into the upright, seating position, the hinge section 28 flexes and allows the back section 30 to move upward as illustrated. As discussed previously, in previously available foam-core futon mattresses, the monolithic piece of polyurethane foam that formed the core of the mattress had a tendency to cause the back portion of the mattress to flex toward the flat, horizontal position. The inherent spring force created by the foam core caused the mattress 18 to slide off of the frame of the convertible furniture 10.

In accordance with the present invention, the hinge section 28 is formed from visco-elastic foam, commonly referred to as memory foam. Visco-elastic foam is an extremely high-density, open cell foam having a "memory" such that the foam retains its shape for a period of time after being compressed. As illustrated in FIG. 3, when the back section 30 is moved to the upright seating position, the visco-elastic foam of the hinge section 28 is the only portion of the mattress 18 to flex. As the visco-elastic foam of the hinge section 28 compresses, the "memory" feature of the visco-elastic foam allows the hinge section 28 to remain in the compressed position as illustrated. Thus, the visco-elastic foam of the hinge section 28 does not try to snap the mattress 18 back to its flat position and cause the mattress 18 to slide off of the furniture frame.

In the preferred embodiment of the invention, the visco-elastic foam of the hinge section 28 has a thickness approximately equal to the five inch thickness of the polyurethane foam that comprises both the back section 30 and the seat section 26. The hinge section 28 has a length of approximately twelve inches between its first end 56 and its second end 58. Preferably, the hinge section 28 is formed from a visco-elastic foam available from Leggett & Platt under product number 25010MF. The properties of the visco-elastic foam of the invention are as follows:

| | |
|---|---|
| Density | 2.4 to 2.6 lbs/ft$^3$ |
| Support Factor | 2.0 (minimum) |
| Indention Force (lbs. @ 25% deflection) | 8–12 lbs. |
| Tensile Strength | 4.0 psi (minimum) |
| Elongation | 150% (minimum) |
| Tear Resistance | 1.0 pli (minimum) |

As can be seen in FIG. 4, the top face surface 60 and the bottom face surface 62 of the visco-elastic foam of the hinge section 28 is generally coplanar with the top and bottom face surfaces of the seat section 28 and back section 30 when the mattress is in the flat, sleeping position. Thus, when a person is lying on top of the mattress 18, the user will not feel the difference in the cushioning properties of the polyurethane foam that forms the seat section 26 and the back section 30 and the visco-elastic foam that forms the hinge section 28.

Figure 5:
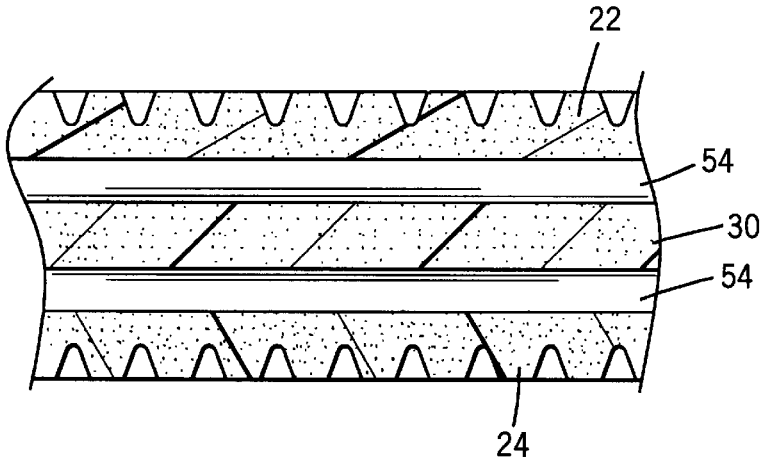
FIG. 5 is a partial section view taken along line 5—5 of FIG. 4.
Figure 6:
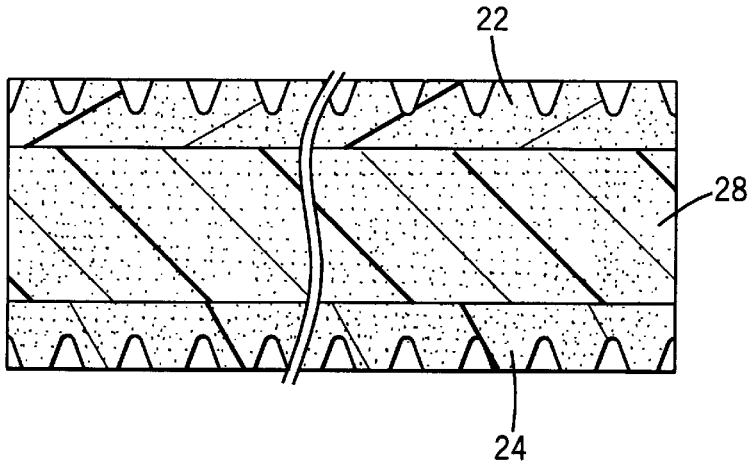
FIG. 6 is a partial section view taken along line 6—6 of FIG. 4.

Referring now to FIGS. 4–6, the mattress 18 of the present invention includes both a top foam layer 22 and a bottom foam layer 24. Both the top and bottom foam layers are a continuous piece of the two inch thick convoluted polyurethane foam that is adhesively attached to the top and bottom face surfaces of each section of the foam core 20. The top and bottom foam layers 22 and 24 provide for a uniform appearance and feel for the mattress 18 of the present invention. Preferably, both the top and bottom foam layers 22, 26 are adhesively attached to the respective top surfaces of the foam core 20.

In the present application, the polyurethane foam that forms the seat section 26 and the back section 30 is described as being formed from polyurethane foam having the identical properties for each. It is contemplated by the inventors that the density for the foam in the back section 30 and the seat section 26 could be different to provide a different level of support for the user's back and seat. For example, the seat section 26 could be formed from polyurethane foam that is less firm than the foam used to form the back section 30. In addition, it is contemplated that the top and bottom foam layers 22 and 24 could be removed and replaced with cotton or polyester batting while still falling within the scope of the intended invention.

Although not illustrated in the Figures, the futon mattress 18 is typically covered with a fabric material before being used on the convertible furniture 10 as illustrated in FIG. 1. The fabric cover both protects the foam mattress 18 as well as provides an aesthetically pleasing appearance for the mattress 18.

Various alternatives and embodiments are contemplated as being within the scope of the following claims particularly pointing out and distinctly claiming the subject matter regarded as the invention.

We claim:

1. An articulated mattress for use in both a sleeping position and a sitting position, comprising:

a first support section formed from foam, the first support section including an outer edge and an inner edge;

a second support section formed from foam, the second support section including an outer edge and an inner edge; and a hinge section connecting the first support section to the second support section such that the first support section and second support section can move relative to each other between the sleeping position and the sitting position, the hinge section being formed from visco-elastic foam that retains its shape upon being compressed as the first and second support sections are moved relative to each other.

2. The mattress of claim 1 wherein the first support portion is a seat portion and the second support portion is a back portion when the mattress is in the sitting position.

3. The mattress of claim 1 wherein the hinge section is adhesively bonded to both the inner edge of the first support section and the inner edge of the second support section.

4. The mattress of claim 1 further comprising:

a top foam layer attached to a front face surface of the first support section, the second support section and the hinge section; and a bottom foam layer attached to a back face surface of the first support section, the second support section and the hinge section.

5. The mattress of claim 4 wherein the top foam layer and the bottom foam layer are formed from a high-density, convoluted foam.

6. The mattress of claim 1 wherein the first support section and the second support section are formed from polyurethane foam.

7. An articulated mattress for use with a futon movable between a sleeping position and a sitting position, the mattress comprising:

a seat section formed from polyurethane foam, the seat section having an outer edge and an inner edge;

a back section formed from polyurethane foam, the back section having an outer edge and an inner edge; and a hinge section adhesively attached between the inner edge of the seat section and the inner edge of the back section such that the hinge section flexes to permit movement of the seat section and back section between the sleeping position and the sitting position, the hinge section being formed from a visco-elastic foam that retains its shape upon being compressed as the back section and the seat section are moved relative to each other.

8. The mattress of claim 7 wherein the seat section includes a front face surface and a back face surface, the back section includes a front face surface and a back face surface, and the hinge section includes a front face surface and a back face surface, the mattress further comprising:

a continuous top foam layer attached to the front face surfaces of the first support section, the second support section and the hinge section; and a continuous bottom foam layer attached to the back face surfaces of the first support section, the second support section and the hinge section.

9. The mattress of claim 8 wherein the top foam layer and the bottom foam layer are formed from a high-density, convoluted foam.

10. The mattress of claim 7 wherein the thickness of the hinge section, the back section and the seat section are substantially identical.

* * * * *